United States Patent [19]

Cutler

[11] 4,103,973

[45] Aug. 1, 1978

[54] DEPTH CONTROL FOR ASPHALT PAVEMENT MILLING MACHINE

[75] Inventor: Earl F. Cutler, Lawrence, Kans.

[73] Assignee: Cutler Repaving, Inc., Lawrence, Kans.

[21] Appl. No.: 785,308

[22] Filed: Apr. 6, 1977

[51] Int. Cl.[2] ..... E01C 23/12

[52] U.S. Cl. ..... 299/39; 172/407

[58] Field of Search ..... 299/39–42; 404/98, 84, 75, 90, 91; 172/413, 407

[56] References Cited

U.S. PATENT DOCUMENTS

| | | | |
|---|---|---|---|
| 1,144,370 | 6/1915 | Maurer | 172/423 |
| 2,905,456 | 9/1959 | Rafferty et al. | 299/39 |
| 3,606,468 | 9/1971 | Walker et al. | 299/39 |
| 3,638,540 | 2/1970 | Williams | 404/84 |
| 3,873,226 | 3/1975 | Teach | 404/84 |
| 3,877,830 | 4/1975 | James | 464/84 |

*Primary Examiner*—Ernest R. Purser
*Assistant Examiner*—William F. Pate, III
*Attorney, Agent, or Firm*—Olson, Trexler, Wolters, Bushnell & Fosse, Ltd.

[57] ABSTRACT

An asphalt pavement milling machine is disclosed which includes mechanism for precisely controlling the depth of cut made by a rotating milling head carried on a machine frame. The depth-of-cut control apparatus includes a shoe adapted to slide over the pavement, and fluid power cylinder means which urge the shoe toward and away from the head-carrying frame through a rocker arm and a vertical slide. A similar device can be mounted upon an opposite side of the machine frame. A fluid power system interconnects the operating cylinders to level the frame and provide smooth, stress-free operation.

20 Claims, 6 Drawing Figures

FIG.4
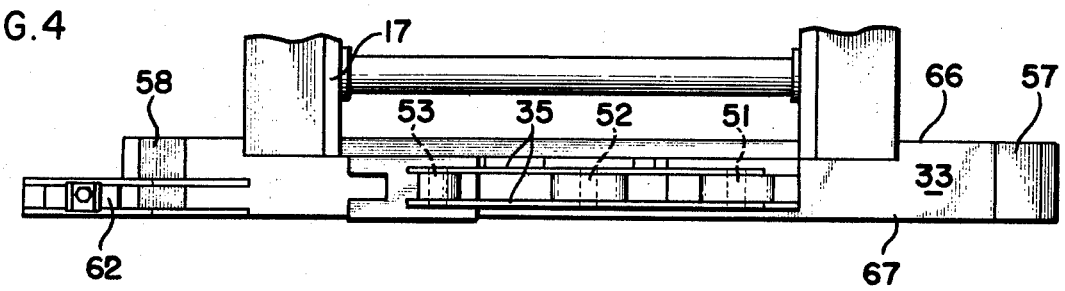
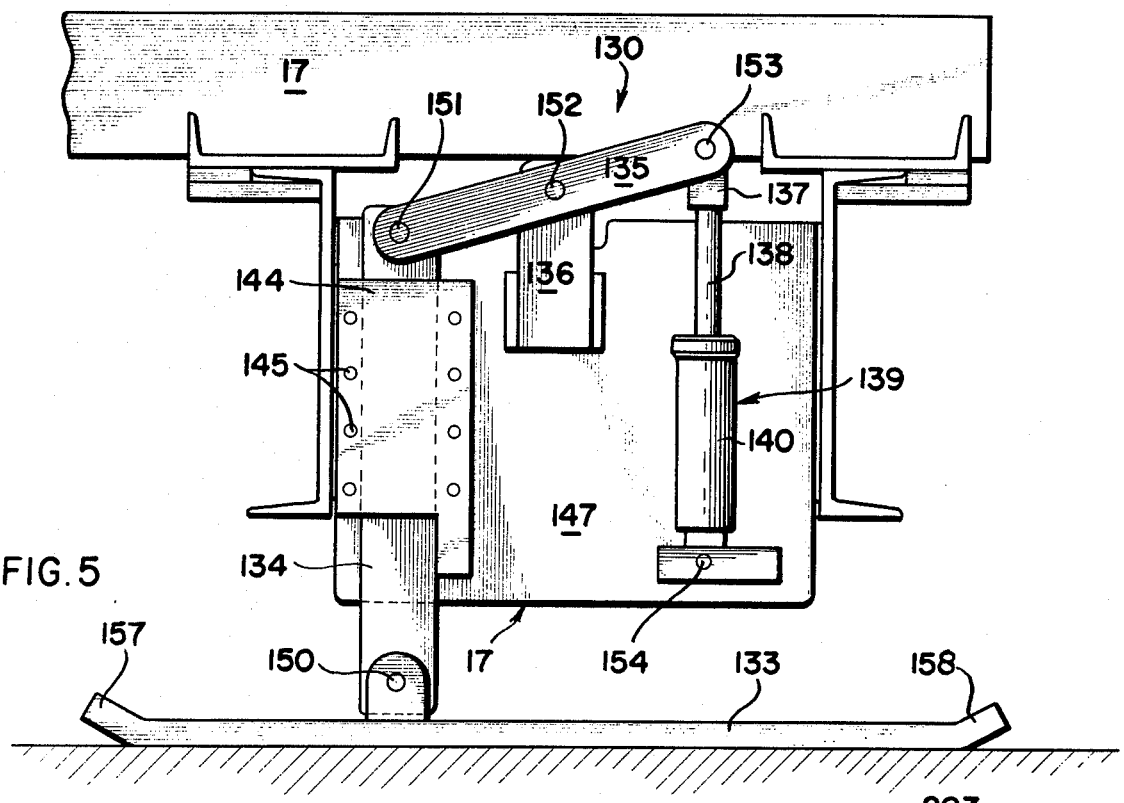
FIG.5
FIG.6
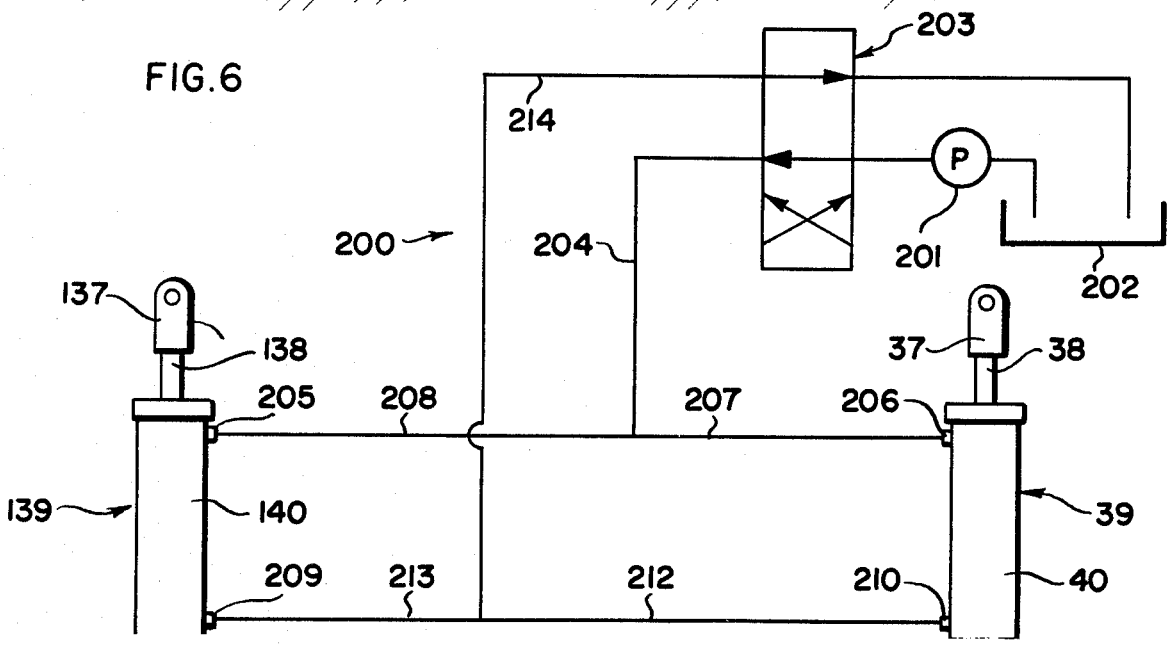

DEPTH CONTROL FOR ASPHALT PAVEMENT MILLING MACHINE

BACKGROUND OF THE INVENTION

This invention relates to a depth-of-cut control mechanism for a pavement milling machine.

The repair of asphaltic concrete pavement surfaces has become an important activity in recent years. To motorists, this repair work is essential for easy, care-free driving. To governmental departments and others in charge of street and highway repair, this activity can constitute a major portion of a budget. To repair contractors, such work can be profitable if it is done rapidly, effectively, and at low cost.

A machine which has recently been offered with marked commercial success for use in making such pavement repairs is that disclosed in co-pending U.S. patent application Ser. No. 757,886 filed Jan. 10, 1977. In general, this machine includes a prime mover, from which rearwardly extends a main apparatus frame carrying a forwardly-turning rotary cutting or milling head. As this head mills away the damaged pavement, the milled, shattered pavement fragments are thrown forwardly and upwardly to a chamber, where a new coating of binder liquid is applied to them. The newly coated loose road material then can be compacted or otherwise worked to form a new pavement surface or road by conventional road construction equipment.

In operating this pavement milling coating machine, it is important to precisely control the depth of cut made by the milling head. Precise control of cut depth permits a damaged course of pavement to be removed and prepared for repaving without disturbing an underlying pavement course. This precise control also minimizes or eliminates the unnecessary removal or reworking of paving course material which can properly be left undisturbed.

It is therefore the general object of the present invention to provide a depth-of-cut control mechanism which is especially adapted for use with the described pavement milling and reworking machine disclosed in the foregoing patent application. A related object is to provide a control mechanism and related system which will permit a pavement milling machine to smoothly mill away a precise amount of pavement material, leaving adjacent pavement material or pavement layers undisturbed.

Another object is to provide such a depth-of-cut control mechanism and related adjustment system which will minimize the strain placed upon the machine frame and other portions of the machine. An allied object is to provide such a mechanism and related system which will minimize or eliminate uneven tensions and pulls placed upon the frame and machine.

Yet another object is to provide a depth-of-cut control system and related apparatus which will provide a clean, positive, commercially attractive side to the formed cut. A related object is to provide such a mechanism which will cut away material located directly adjacent distinct areas such as elevated gutters, curbs, and the like.

Yet another object is to provide such a mechanism which is positive acting in nature, and is only minimally subject to fouling and damage from dirt and corruption.

A further object is to provide a mechanism of the type described at a commercially attractive cost.

A still further object is to provide such a mechanism in a form which is reliable and rugged in operation, and which will provide a long service life with minimal attention and maintenance.

Other objects and advantages of the invention will become apparent upon reading the following detailed description and upon reference to the drawings. Throughout the drawings, like reference numerals refer to like parts.

BRIEF DESCRIPTION OF THE DRAWINGS

FIG. 4 is a fragmentary top plan view of a portion of the machine and the associated depth-of-cut control mechanism;

FIG. 5 is a fragmentary left side elevational view similar to FIG. 3; and FIG. 6 is a schematic view of the depth-of-cut control mechanism and an associated hydraulic system.

DETAILED DESCRIPTION

While the invention will be described in connection with a preferred embodiment, it will be understood that it is not intended to limit the invention to this embodiment. On the contrary, it is intended to cover all alternatives, modifications, and equivalents as may be included within the spirit and scope of the invention.

Figure 1:
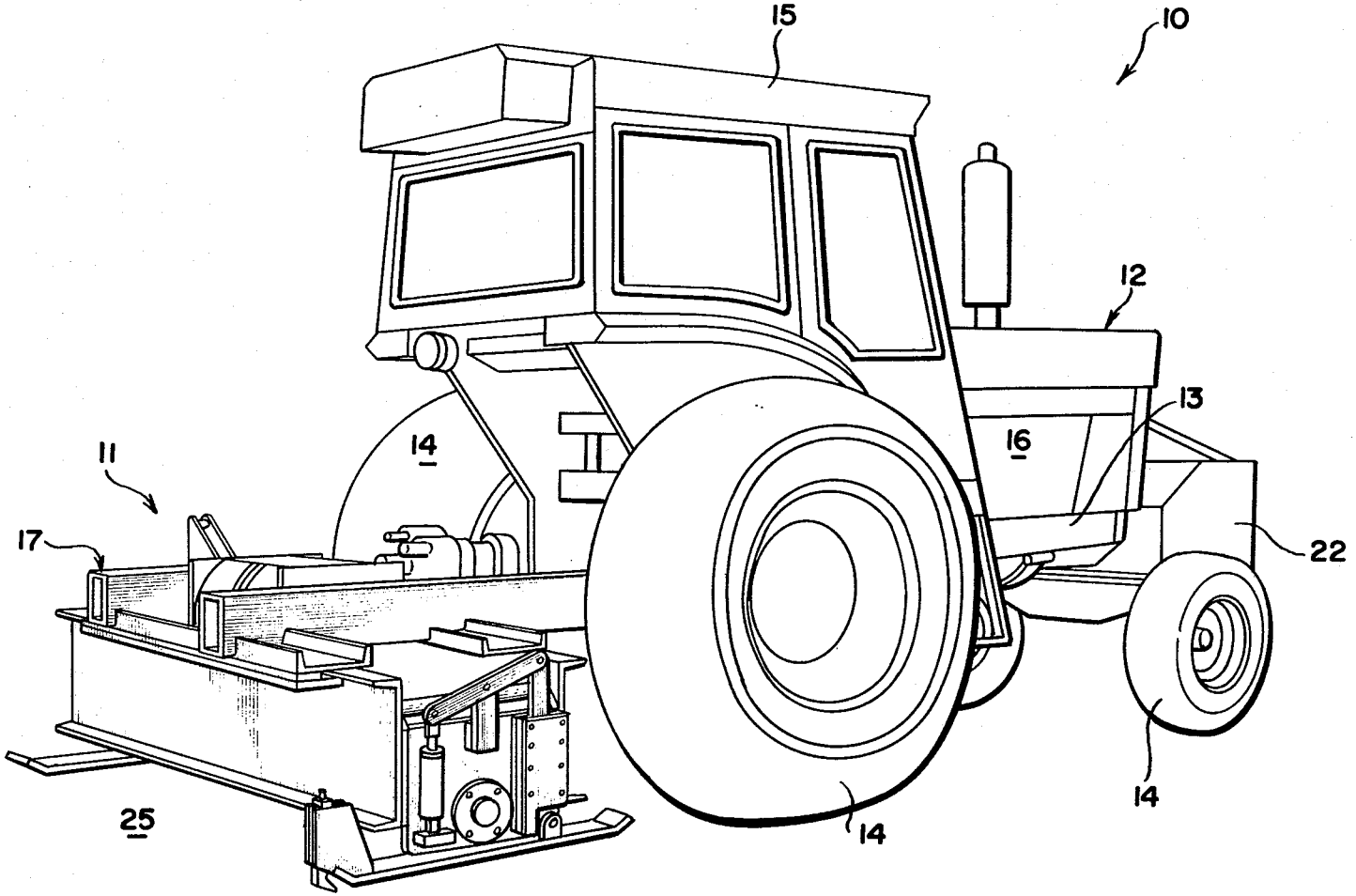
FIG. 1 is a perspective view showing, in its general aspect, a pavement milling and re-cycling machine as it appears when equipped with the novel depth-of-cut control mechanism.
Figure 2:
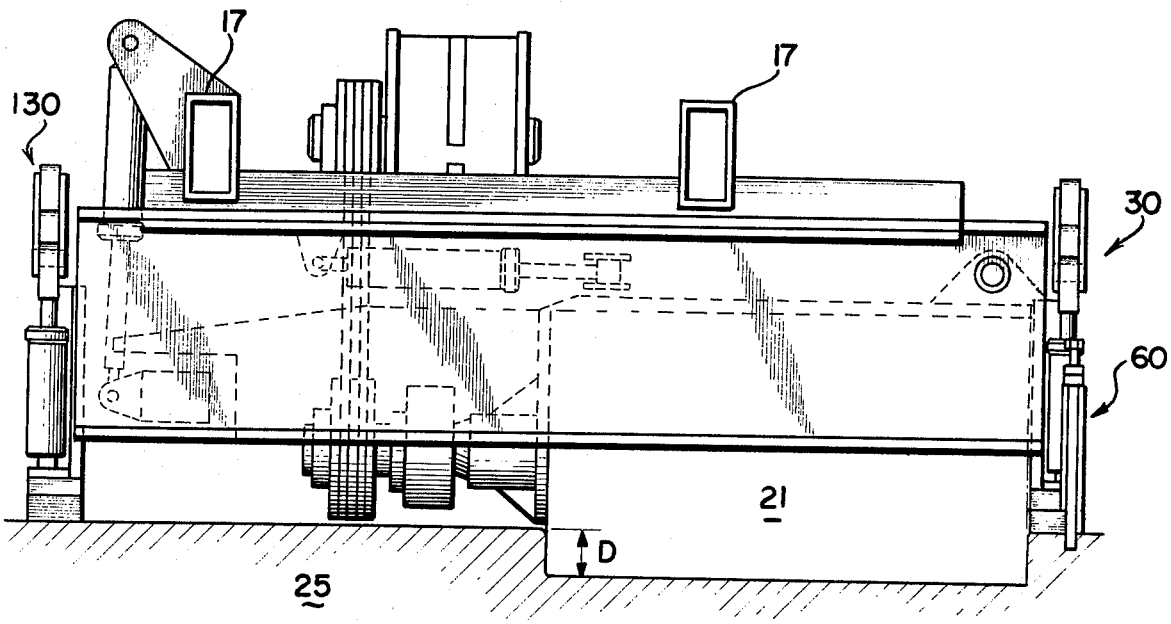
FIG. 2 is a fragmentary rear elevational view of the machine and the depth-of-cut control mechanism.

Turning first to FIGS. 1 and 2, there is shown an asphalt pavement milling machine 10 which here takes the form of pavement milling and reconditioning apparatus 11 extending from the rear of a tractor 12. Desirably, the tractor 12 can be of the large farm tractor type, and is equipped with a hydrostatic drive. This tractor generally includes a mobile vehicle frame 13 mounted upon tires 14 and a cab 15 which can be closed to provide an operator's station protected from the environment. A power plant 16 drives the machine 10 along a line of travel by guidance from the machine operator.

Between the sides of a rearwardly extending frame 17 is mounted a milling head 21 for forward cutting rotation. A tank 22 conveniently mounted at the front of the tractor 12 carries an asphalt-rejuvenating liquid to be sprayed from nozzles (not shown) upon the shattered pavement fragments milled from a course of pavement 25 being worked by the machine.

Figure 3:
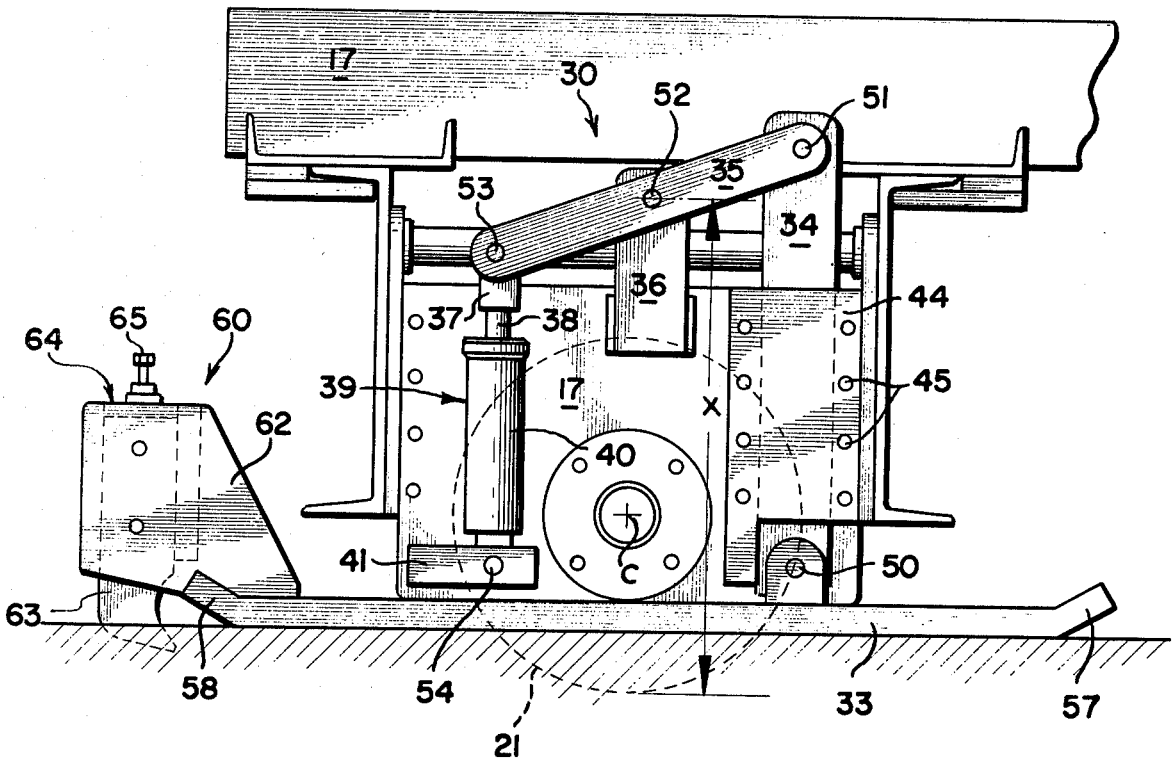
FIG. 3 is a fragmentary right side elevational view showing in further detail the depth-of-cut control mechanism.

In accordance with one aspect of the invention, depth control means 30 are provided for locating the frame 17 at a precise distance above the pavement 25 to be milled. By so locating the frame 17, the forwardly turning rotary milling head 21 is also precisely located in a vertical direction so as to provide a cut of precise depth D in the pavement 25. To provide smooth operation and as shown in FIG. 3 the depth control mechanism 30 includes an elongated depth control shoe 33. This shoe 33 is pivotally connected to a slide 34 mounted for vertical motion upon the frame 17. A rocker arm 35 is pivoted both to this slide 34 and to an extension 36 of the frame 17. At an opposite end, the rocker arm 35 is connected to a clevis 37 affixed to the rod 38 of a fluid power cylinder assembly 39. Here this fluid power cylinder assembly 39 takes the form of a hydraulic cylinder 40 from which the rod 38 can be caused to extend and retract. The cylinder 40 is itself pivotally connected, as by a bracket 41, to the frame 17.

In operation, when the cylinder rod 38 is extended, the rocker arm 35 rotates about the frame extension 36 in a clockwise direction. This rocker arm motion forces the vertical slide 34 downwardly so as to extend the vertical distance between the depth control shoe 33 and the frame 17 itself, thus elevating the milling head 21 and providing a smaller depth of cut D. When the fluid power cylinder 39 is actuated so as to retract the rod 38 partially into the cylinder body 40 the action of the depth control mechanism 30 is reversed, thereby drawing the depth control shoe 33 relatively toward the frame 17 and providing a relatively greater depth of cut D for the milling head 21. In this way the frame 17 and head 21 are located at a precise distance above the pavement 25 to be milled. To secure the slide 34 for easy vertical motion, a slide sheath plate 44 is secured, as by bolts 45 upon an end plate 47 constituting a portion of the frame 17. Appropriate pins 50–54 pivotally interconnect the shoe 33, slide 34, rocker arm 35, cylinder rod clevis 37 and cylinder body 41 and frame 17.

Pursuant to another aspect of the invention, the depth control shoe 33 accommodates undulations or obstructions in the pavement 25. To this end, the shoe 33 extends over its length from an upturned toe 57 past the center of rotation C of the milling head 21 to an upturned heel 58. To smooth the control action, the shoe-slide interconnecting pivot point and pin 50 are located at a point ahead of the center C of milling head rotation. To obtain easy, unforced, rocker arm and slide action with rugged part sizes, a slide extension 36 locates the center of rotation of the rocker arm 35 at a distance X above the pavement 25 which is substantially equal to the distance above the pavement at which the slide/-rocker arm pivot pin 51 is located. It will be noted that the cylinder rod 38 and a rod-body seal are located so as to minimize inpingement of dirt and corruption, thereby adding to service life and minimizing repair costs. To this end, the cylider assembly 39 is arranged on the machine 10 so as to connect the rod 38 to the rocker arm 35, and the cylinder body 40 to the frame 17.

In accordance with a further aspect of the invention, this depth-of-cut mechanism 30 also provides a clean, positive, commercially attractive side to the cut being formed by the milling head. To this end, a curb line cutter mechanism 60 is mounted upon the shoe trailing heel 58. Here this curb line cutter 60 includes a cutter mount 62 carrying a knife element 63 for vertical motion within a mount pocket 64. A vertical adjustment pusher bolt 65 adjusts the vertical position of the knife element 63 relative to the knife mount 62 and shoe 33 so as to provide a clean, vertical side of given depth to the milled cut. As shown in FIG. 4, the shoe 33 is defined by an inboard edge 66 and an outboard edge 67; to permit easy control of the cut side and maximize the width of the cut, the knife element 63 and the mounting means 62 are secured outboard of the milling head 21 to the outboard side 67 of the control shoe 33.

As explained above, the present invention is at least partly concerned with minimizing unnecessary stresses and strains within the frame 17 and other portions of the machine 10. To this end, a similar depth-of-cut mechanism 130 is mounted at an opposite, or left, side of the frame 17, as more particularly shown in FIGS. 1, 2 and 5. (In the drawings, left-hand assembly parts similar to those right-had assembly parts shown in FIGS. 1–4 are designated by like reference numerals preceeded by the suffix 1.) Thus, when a fluid power cylinder 139 is properly energized, a rod 138 is extended from the cylinder body 140, thereby urging upwardly the rod clevis 137 so as to rotate in a counter-clockwise direction the rocker arm 135 about its pivot pin 152. This motion causes a vertical slide 134 to be urged downwardly relative to a frame end plate 147 and consequently urge a left shoe 133 downwardly away from the frame 17 and left frame end plate 147. Here, no curb cutter mechanism is provided upon the shoe 133 since the milling head 21 does not extend to a position adjacent the left end frame plate 147 and no milling activity occurs adjacent this left depth-of-cut adjustment mechanism. However, it will be evident that an end cutter mechanism could be installed, if desired, upon a heel 158 of the shoe 133 outboard of the milling head 21 to provide a precise, positive left side or end to the cut.

In accordance with yet another aspect of the invention, pressure experienced in the fluid power cylinders 39 and 139 is equalized so as to level the frame 17 relative to the pavement 25 and parallel to pull points on the tractor 10. To this end, the fluid power circuit 200 illustrated in FIG. 6 includes a source of pressurized fluid such as a pump 201 which draws fluid from a reservoir or surge tank 202. When it is desired to lower the frame 17 relative to the pavement 25, a valve 203 is positioned as illustrated so as to deliver fluid along a charge line 204 for ingress through rod end ports 205 and 206 of the respective cylinders 139 and 39 through branch lines 207 and 208. Under these circumstances the rods 38 and 138 are retracted so as to lower the frame 17, as explained above, down toward from the respective shoes 33 and 133. Simultaneously, fluid is egressed or exhausted from rod blind or head end ports 209 and 210 through branch lines 212 and 213 to a header line 214.

Conversely, when it is desired to raise the frame 17 relative to the shoes 33 and 133, this action is caused to occur in a positive, definite, precise manner. To this end, when the machine operator in the cab 15 throws the valve 203 (through controls not shown) the pump 200 is caused to discharge high pressure fluid to the main header lines 214. This fluid charge exerts pressure, through the branch lines 212 and 213, through to the cylinder blind end ports 209 and 210 so as to positively extend the rods 38 and 138 into the cylinder bodies 40 and 140. In this way, the frame 17 is positively raised as the shoes 33 and 133 are pushed downwardly away from the frame 17.

It will be noted that the pressure experienced in the cylinders 39 and 139 is equalized in an inexpensive manner. To accomplish this, the header conduits 204 and 124 and the branch conduits 207, 208, 212 and 213 are adapted to permit fluid flow in either direction back and forth between the fluid power cylinders 39 and 139. This pressure equalization encourages the frame 17 to level itself relative to the pavement 25 and parallel to the pull points of the tractor 12.

The invention is claimed as follows:

1. An asphalt pavement milling machine having a frame adapted for movement along a line of machine travel, rotary milling means rotatably carried on the frame for milling engagement with the pavement, and depth-of-cut control means for locating the frame at a precise distance above the pavement to be milled so as to locate the rotary milling means relative to the pavement to provide a precise depth of cut, the depth-of-cut control means including depth control shoe means adapted to slide over the pavement, slide means connected to the shoe and carried for vertical sliding motion on the frame, rocker arms means pivotally connected to the slide means and to the main frame, and fluid power cylinder means having a cylinder body and a rod partially extensible from and retractable into the cylinder body, the cylinder means being pivoted to the main frame and to the rocker arm, cylinder rod movement relative to the cylinder body thus operating to rock the rocker arm means, slide the slide means, and raise and lower the shoe means relative to the frame.

2. An asphalt pavement milling machine according to claim 1 wherein said depth control shoe means extends from a point in front of the milling head to a point behind the milling head so as to provide smooth, precise depth-of-cut control.

3. An asphalt pavement milling machine according to claim 1 wherein said depth control shoe means is pivoted to said slide means to permit said shoe means to accommodate undulations in the pavement.

4. An asphalt pavement milling machine according to claim 3 including pivot pin means interconnecting said vertical slide means and said shoe means at a point ahead of the center of rotation of the rotary milling means so as to raise said rotary milling means when the machine encounters an obstruction on the pavement surface.

5. An asphalt pavement milling machine according to claim 1 including slide sheath means fixed to said frame outside one end of said frame to carry said slide means for vertical sliding motion over the outside of said frame.

6. An asphalt pavement milling machine according to claim 1 including frame extension means affixed to said frame and pivotly carrying said rocker arm means so as to locate the rocker arm/frame pivot point at a distance above the pavement which is substantially equal to the distance of the pavement at which the slide/rocker arm pivot point is located so as to encourage easy, unforced depth-of-cut mechanism action.

7. An asphalt pavement milling machine according to claim 1 wherein said cylinder rod is pivotally connected to said rocker arm, and wherein said cylinder body is pivotally connected to said frame whereby to locate said rod and a cylinder seal between said rod and body at locations for minimal impingement and collection of dirt and corruption.

8. An asphalt pavement milling machine according to claim 7 including rod end and head end fluid ports carried upon said cylinder body and providing positive fluid ingress and egress to the rod end and the head end of said cylinder for positively urging the cylinder rod into extend and to retract relative to said cylinder body.

9. An asphalt pavement milling machine according to claim 1 wherein said shoe means is at least partly defined by a leading end and a trailing end, and wherein said asphalt pavement milling machine further includes curb line cutter means carried upon the shoe means trailing end to define a positive side to the milled cut formed by the rotary milling means.

10. An asphalt pavement milling machine according to claim 9 wherein said shoe means is partly defined by an inboard edge and an outboard edge, the curb line cutter means including a knife element, and mounting means securing the knife element to the shoe means at the outboard shoe edge.

11. An asphalt pavement milling machine according to claim 10 including knife pusher means interconnecting the knife element and the knife mounting means for a vertically adjusting the position of the knife element relative to its mounting means so as to provide a clean, vertical side of given depth to the milled cut.

12. An asphalt pavement milling machine according to claim 1 wherein said shoe is mounted relatively outboard of the milling means.

13. An asphalt pavement milling machine having a bi-sided frame adapted for movement along a line of machine travel, rotary milling means rotatably carried on the frame and located between the frame sides for milling engagement with the pavement, and depth control means mounted on each frame side for locating the frame at a precise distance above the pavement to be milled, each depth control means including a depth control shoe adapted to engage and slide over the pavement, extensible fluid power cylinder means functionally interposed between the frame and the associated depth control shoe to raise and lower the frame and said milling means relative to that shoe, and a fluid power circuit means including a source of pressurized fluid and conduit means connecting each fluid power cylinder to the source of pressurized fluid and connecting each fluid power cylinder to every other fluid power cylinder in a parallel connection arrangement whereby to level said frame relative to the pavement over which the frame is traveling.

14. An asphalt pavement milling machine according to claim 13 including two-way flow conduit means permitting fluid flow back and forth between said fluid power cylinders, whereby to equalize the fluid pressure experienced in the cylinders and thereby level the frame relative to the pavement and locate the frame parallel to the pull points of the tractor.

15. An asphalt pavement milling machine according to claim 13 including slide means and rocker arm means interconnecting the extensible fluid power cylinder means and the associated shoe means for transmitting extending fluid power cylinder action to the shoe means.

16. An asphalt pavement milling machine according to claim 5 wherein each slide means is connected to the associated said shoe means and is carried for vertical sliding motion on said frame, and wherein said rocker arm means is pivotally connected to said slide means and to the main frame to force said shoe means downwardly away from said frame when said fluid power cylinder is actuated so as to extend said fluid power cylinder rod from said fluid power cylinder body.

17. An asphalt pavement milling machine according to claim 16 wherein said fluid power cylinder means includes at least one fluid power cylinder rod pivotally connected to said associated rocker arm, and at least one fluid power cylinder body pivotally connected to the frame for locating that rod and an associated cylinder seal in a position for minimal impingement by dirt and corruption.

18. An asphalt pavement milling machine according to claim 13 wherein each shoe means extends from a point in front of the milling head to a point beind the milling head, and wherein said show means is pivotally connected to the fluid power cylinder means so as to accommodate undulations in the pavement.

19. An asphalt pavement milling machine according to claim 13 wherein each said shoe means is movably carried on said frame at a position relatively outboard of the milling means.

20. An asphalt pavement milling machine according to claim 13 including rod end and blind end fluid ports interconnecting said conduit means and said fluid cylinder to permit said fluid power to positively urge said fluid cylinder rod to extend and retract into and out of said fluid power cylinder body.

* * * * *

UNITED STATES PATENT AND TRADEMARK OFFICE

CERTIFICATE OF CORRECTION

PATENT NO. : 4,103,973

DATED : August 1, 1978

INVENTOR(S) : EARL F. CUTLER

It is certified that error appears in the above-identified patent and that said Letters Patent are hereby corrected as shown below:

Col. 6, line 37, change "claim 5" to --claim 15--;

Col. 6, line 55, change "show" to --shoe--.

Signed and Sealed this

*Seventeenth* Day of *April 1979*

[SEAL]

*Attest:*

RUTH C. MASON
*Attesting Officer*

DONALD W. BANNER
*Commissioner of Patents and Trademarks*